US009625925B2

(12) United States Patent
Yan et al.

(10) Patent No.: US 9,625,925 B2
(45) Date of Patent: Apr. 18, 2017

(54) LINEAR REGULATOR HAVING A CLOSED LOOP FREQUENCY RESPONSE BASED ON A DECOUPLING CAPACITANCE

(71) Applicant: Silicon Laboratories Inc., Austin, TX (US)

(72) Inventors: Shouli Yan, Austin, TX (US); Axel Thomsen, Austin, TX (US); Praveen Kallam, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 15 days.

(21) Appl. No.: 14/551,923

(22) Filed: Nov. 24, 2014

(65) Prior Publication Data

US 2016/0147239 A1 May 26, 2016

(51) Int. Cl.

| | |
|---|---|
| ***G05F 1/575*** | (2006.01) |
| ***G05F 1/573*** | (2006.01) |
| ***G05F 1/56*** | (2006.01) |

(52) U.S. Cl.

CPC ..... *G05F 1/575* (2013.01); *G05F 1/56* (2013.01); *G05F 1/573* (2013.01)

(58) Field of Classification Search

CPC ..... G05F 1/575
USPC ..... 323/299, 280, 274
See application file for complete search history.

(56) References Cited

U.S. PATENT DOCUMENTS

| | | | | |
|---|---|---|---|---|
| 7,843,180 | B1 * | 11/2010 | Cilingiroglu | G05F 1/575 323/274 |
| 2009/0243580 | A1 * | 10/2009 | Chen | H02M 3/156 323/288 |
| 2010/0181975 | A1 * | 7/2010 | Piselli | H02M 3/33507 323/282 |
| 2014/0084994 | A1 * | 3/2014 | Merkin | G05F 1/56 327/543 |
| 2014/0265899 | A1 * | 9/2014 | Sadwick | H05B 33/0812 315/200 R |
| 2014/0266106 | A1 * | 9/2014 | El-Nozahi | G05F 1/575 323/280 |
| 2015/0061757 | A1 * | 3/2015 | Guo | G05F 1/575 327/540 |
| 2015/0137780 | A1 * | 5/2015 | Lerner | G05F 1/565 323/280 |
| 2015/0220096 | A1 * | 8/2015 | Luff | G05F 1/56 327/109 |
| 2015/0362550 | A1 * | 12/2015 | Wibben | G01R 31/2853 324/750.3 |

* cited by examiner

*Primary Examiner* — Matthew Nguyen
*Assistant Examiner* — Trinh Dang
(74) *Attorney, Agent, or Firm* — Trop, Pruner & Hu, P.C.

(57) ABSTRACT

A method includes using a pass device of a linear regulator to provide an output signal to an output of the linear regulator in response to a signal that is received at a control terminal of the pass device. The method includes using the linear regulator to regulate the signal received at the control terminal based at least in part on the output signal; and controlling a closed loop frequency response of the linear regulator to cause a direct current (DC) gain of the linear regulator to extend to a frequency near or at frequency of a zero that is associated with a decoupling capacitor that is coupled to the output of the linear regulator.

13 Claims, 11 Drawing Sheets

LINEAR REGULATOR HAVING A CLOSED LOOP FREQUENCY RESPONSE BASED ON A DECOUPLING CAPACITANCE

BACKGROUND

Electronic systems typically employ voltage regulators for purposes of generating supply voltages for the various components of the system. One type of voltage regulator is a DC-to-DC switching converter, which typically regulates its output voltage by selectively activating and deactivating switches to energize and de-energize one or more energy storage components of the switching regulator. Another type of voltage regulator is a linear regulator, which typically regulates its output voltage by controlling a difference between the output voltage and the regulator's input voltage. More specifically, a typical linear regulator includes an error amplifier that controls a voltage drop across a pass transistor of the regulator for purposes of regulating the output voltage.

SUMMARY

In accordance with an example embodiment, a method includes using a pass device of a linear regulator to provide an output signal to an output of the linear regulator in response to a signal that is received at a control terminal of the pass device. The method includes using the linear regulator to regulate the signal received at the control terminal based at least in part on the output signal; and controlling a closed loop frequency response of the linear regulator to cause a direct current (DC) gain of the linear regulator to extend to a frequency near or at frequency of a zero that is associated with a decoupling capacitor that is coupled to the output of the linear regulator.

In accordance with another example embodiment, a regulator includes an output, a pass device and a closed loop circuit. The pass device provides an output signal for the output of the regulator in response to a signal that is received at a control terminal of the pass device. The closed loop circuit regulates the signal that is received at the control terminal based at least in part on the output signal. The closed loop circuit includes an error amplifier to regulate the signal received at the control terminal based at least in part on the output signal of the regulator and a reference signal. The error amplifier includes a first amplification stage and a second amplification stage. The second amplification stage is coupled to the output of the first amplification stage and is adapted to provide a bias current feedback to the first amplification stage based at least in part on a current that is provided by the output of the regulator.

In accordance with another example embodiment, an apparatus includes an integrated circuit, which includes a regulator. The regulator includes a closed loop circuit that includes a pass device, a feedback circuit, an amplifier and a filter. The filter is adapted to control a first order roll off frequency of a frequency response of the closed loop circuit to cause the first order roll off frequency to be near or at frequency of a zero that is associated with a load that is coupled to the output.

Advantages and other desired features will become apparent from the following drawings, description and claims.

DETAILED DESCRIPTION

An electronic system may include one or multiple linear regulators for purposes of providing regulated direct current (DC) voltage(s) to power consuming components of the system. For purposes of filtering noise from the corresponding DC supply rail(s), decoupling capacitor(s) may be used. In this manner, the output of a given linear regulator may be coupled to a particular DC supply rail, and a decoupling capacitor may be coupled between the linear regulator's output and ground for purposes of forming a low pass filter to attenuate noise on the DC supply rail. In accordance with systems and techniques that are disclosed herein, a linear regulator has a closed loop frequency gain that takes into account the impedance of the decoupling capacitor.

Figure 1:
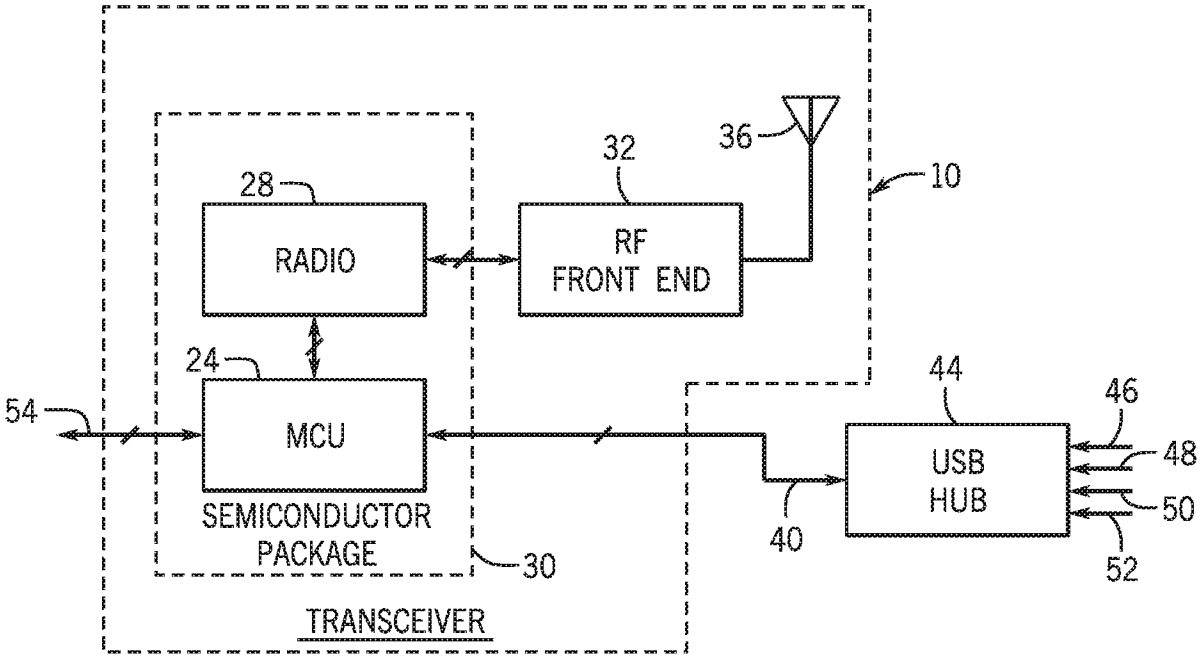
FIG. 1 is a schematic diagram of an electronic system according to an example embodiment.

In accordance with an example embodiment, the electronic system may be a microcontroller unit (MCU)-based electronic system, such as an MCU-based transceiver 10 that is depicted in FIG. 1. Referring to FIG. 1, in accordance with embodiments, the MCU 24 may control various aspects of the transceiver 10 and may be part of an integrated circuit, or semiconductor package 30, which also includes a radio 28. As a non-limiting example, the MCU 24 and the radio 28 may collectively form a packet radio, which processes incoming and outgoing streams of packet data. To this end, the transceiver 10 may further include a radio frequency (RF) front end 32 and an antenna 36, which receives and transmits RF signals (frequency modulated (FM) signals, for example) that are modulated with the packet data.

It is noted that FIG. 1 merely illustrates an example embodiment of an electronic system, in that the linear regulator-based systems and techniques that are described herein may be applied to other MCU-based electronic systems as well as non-MCU-based electronic systems, in accordance with further example embodiments.

Still referring to FIG. 1, the transceiver 10 may be used in a variety of applications that involve communicating packet stream data over relatively low power RF links and as such, may be used in wireless point of sale devices, imaging devices, computer peripherals, cellular telephone devices, etc. As a specific non-limiting example, the transceiver 10 may be employed in a smart power meter which, through a low power RF link, communicates data indicative of power consumed by a particular load (a residential load, for example) to a network that is connected to a utility. In this manner, the transceiver 10 may transmit packet data indicative of power consumed by the load to mobile meter readers as well as to an RF-to-cellular bridge, for example. Besides transmitting data, the transceiver 10 may also receive data from the utility or meter reader for such purposes (as non-limiting examples) as inquiring as to the status of various power consuming devices or equipment; controlling functions of the smart power meter; communicating a message to a person associated with the monitored load, etc.

As depicted in FIG. 1, in addition to communicating with the radio 28, the MCU 24 may further communicate with other devices and in this regard may, as examples, communicate over communication lines 54 with a current monitoring and/or voltage monitoring device of a smart power meter (as a non-limiting example) as well as communicate with devices over a serial bus 40. In this manner, the serial bus 40 may include data lines that communicate clocked data signals, and the data may be communicated over the serial bus 40 data in non-uniform bursts. As a non-limiting example, the serial bus may be a Universal Serial Bus (USB) 40, as depicted in FIG. 1, in accordance with some embodiments. As described herein, in addition to containing lines to communicate data, the serial bus, such as the USB 40, may further include a power line (a 5 volt power line, for example) for purposes of providing power to serial bus devices, such as the MCU 24. Various USB links 46, 48, 50 and 52 may communicate via a hub 44 and USB 40 with the transceiver 10 for such purposes as communicating with a residential computer regarding power usage of various appliances, communicating with these appliances to determine their power usages, communicating with the appliances to regulate their power usages, etc.

Depending on the particular embodiment, some or all of the components of the MCU 24 may be fabricated on a single die of the semiconductor package 30; and in other embodiments, the components of the MCU 24 may be fabricated on more than one die of the semiconductor package 30. Thus, many variations are contemplated, which are within the scope of the appended claims.

Figure 2:
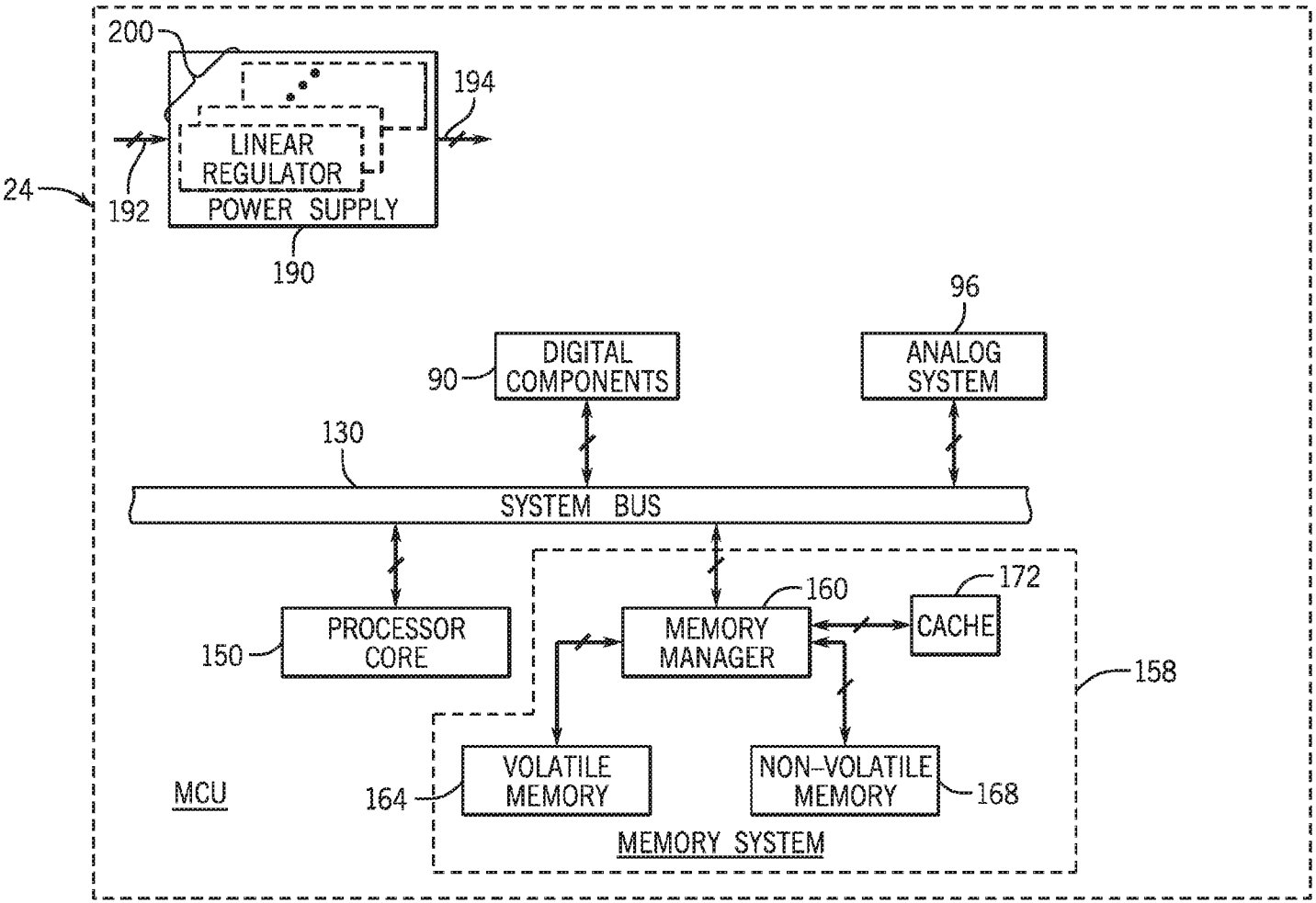
FIG. 2 is a schematic diagram of a microcontroller unit (MCU) of the system of FIG. 1 according to an example embodiment.

Referring to FIG. 2, in accordance with example embodiments, the MCU 24 includes various power consuming components, such as a processor core 150. As a non-limiting example, the processor core 150 may be a 32-bit core, such as the Advanced RISC Machine (ARM) processor core, which executes a Reduced Instruction Set Computer (RISC) instruction set. In further example embodiments, the processor core 150 may be a more powerful core or a less powerful core, such as an 8-bit core (an 8051 core, for example).

In general, the processor core 150 communicates with various other system components of the MCU 24, which also consume power, such as a memory controller, or manager 160, over a system bus 130. In general, the memory manager 160 controls access to various memory components of the MCU 24, such as a cache 172, a non-volatile memory 168 (a Flash memory, for example) and a volatile memory 164 (a static random access memory (SRAM), for example).

The MCU 24 may also include digital and analog devices that consume power. For example the MCU 24 may include various digital peripheral components 90, such as (as examples) a Universal Serial Bus (USB) interface, a programmable counter/timer array (PCA), a universal asynchronous receiver/transmitter (UART), a system management bus (SMB) interface, a serial peripheral interface (SPI), etc. In accordance with some embodiments, the MCU 24 includes an analog system 96, which communicates analog signals on external analog terminals 84 of the MCU 24 and generally forms the MCU's analog interface. As an example, the analog system 96 may include various components that receive analog signals, such as analog-to-digital converters (ADCs), comparators, etc.; and the analog system 96 may include components (supply regulators) that furnish analog signals (power supply voltages, for example) to the terminals 84, as well as components, such as current drivers.

For purposes of providing regulated power to its power consuming components, the MCU 24 includes a power supply 190. The power supply 190 supplies voltages to supply voltage rails 194 for purposes of providing power to the various components of the MCU 24. For this purpose, the power supply 190 may include one or more linear regulators 200 (low dropout (LDO) linear regulators, as a non-limiting example). Depending on the particular embodiment, the power supply 190 may include one or more DC-to-DC switching converters (a Buck switching converter, a boost switching converter, and so forth), which receive an input voltage (a battery voltage communicated to the power supply 190 via inputs 192, for example) and furnish regulated voltages to the inputs of the linear regulators 200.

Figure 3:
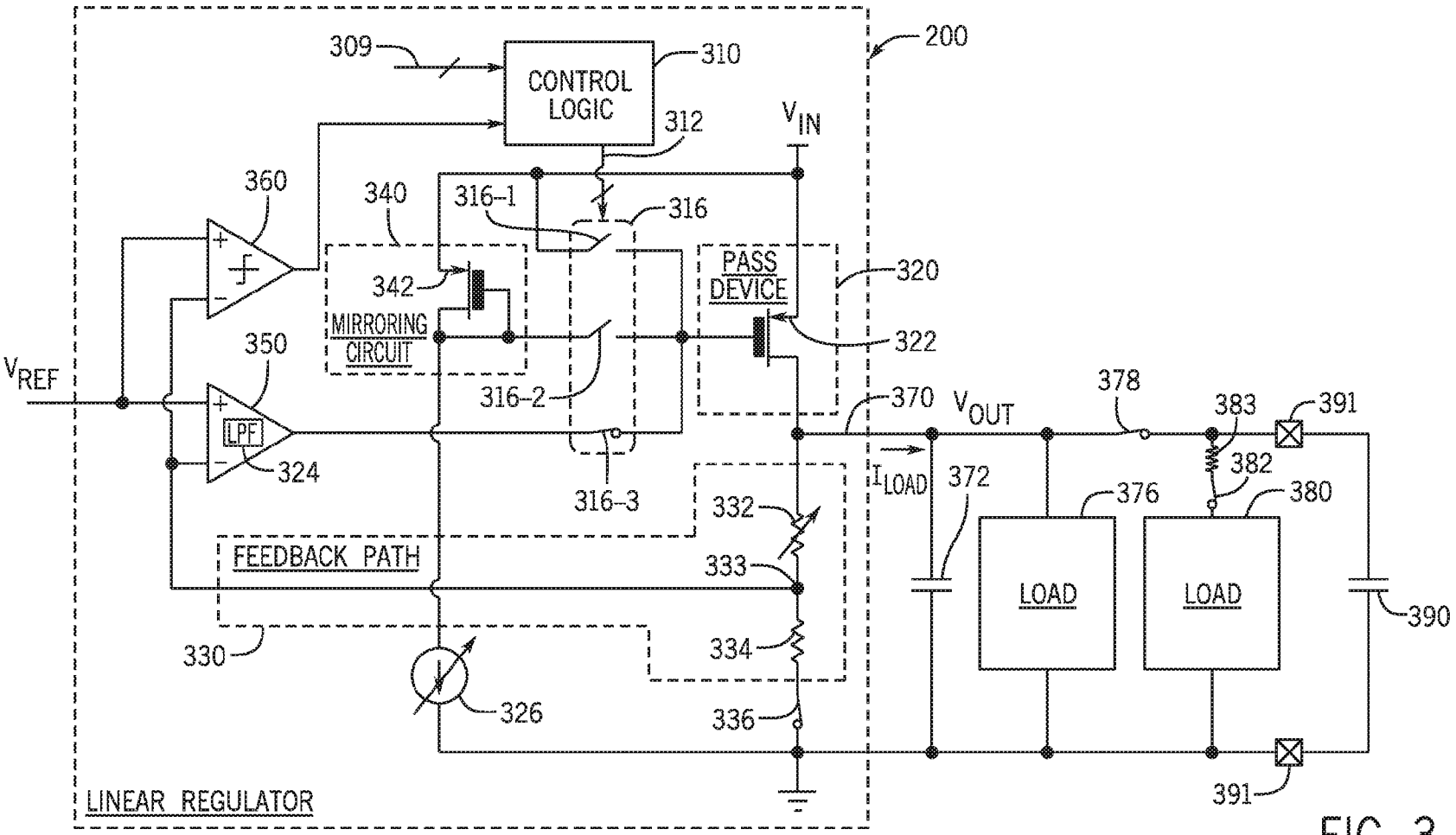
FIG. 3 is a schematic diagram of a linear regulator of the microcontroller unit of FIG. 2 according to an example embodiment.

Referring to FIG. 3, in accordance with some embodiments, a given linear regulator 200 provides a regulated output voltage (called "$V_{OUT}$," in FIG. 3) at its output 370 in response to an input voltage (called "$V_{IN}$," in FIG. 3). In this regard, a pass device 320 of the linear regulator 200 is coupled between an input of the regulator 200, which receives the $V_{IN}$ input voltage and the output 370 that provides the $V_{OUT}$ output voltage. In general, the linear regulator 200 compares the $V_{OUT}$ output voltage to a reference voltage, and based on this comparison, the linear regulator 200 controls the voltage drop across the pass device 320 (i.e., controls the difference between the $V_{IN}$ and $V_{OUT}$ voltages) to regulate the $V_{OUT}$ voltage.

More specifically, in accordance with some embodiments, the linear regulator 200 includes an error amplifier 350, which compares a voltage that is proportional to the $V_{OUT}$ voltage to a reference voltage (called "$V_{REF}$," in FIG. 3). For this purpose, the linear regulator 200 includes a feedback path 330, which is coupled between the output 370 and the non-inverting input of the error amplifier 350. For this example, the inverting input of the error amplifier 350 receives the $V_{REF}$ reference voltage, an output of the error amplifier 350 is coupled to a control terminal of the pass device 320, and the pass device 320 varies the $V_{OUT}$ output voltage with the signal that is received at its control terminal. Due to the negative feedback that is provided by the feedback path 330, in general, an increase in the magnitude of the $V_{OUT}$ output voltage causes the error amplifier 350 to decrease the magnitude of the signal at the control terminal to counter the increase in the $V_{OUT}$ output voltage; and conversely, a decrease in the magnitude of the $V_{OUT}$ output voltage, in general, causes the error amplifier 350 to increase the magnitude of the signal at the control terminal of the pass device 320 to counter the decrease in the magnitude of the $V_{OUT}$ output voltage.

In accordance with example embodiments, the linear regulator 200 of FIG. 3 has two modes of operation: a voltage regulation mode, which is the "normal" mode of operation when the linear regulator 200 is providing power for loads 376 and 380 of the MCU 24; and a current source mode, which is the mode in which the linear regulator 200 limits its output current (called "$I_{LOAD}$" in FIG. 3). The current source mode may be used for such purposes as limiting inrush current during startup of the linear regulator 200 or the $V_{OUT}$ output voltage is changed (by changing the $V_{REF}$ reference voltage) from a lower voltage to a higher voltage. The selection of the particular mode of operation for the linear regulator 200 is controlled by control logic 310. As depicted in FIG. 3, the control logic 310 may receive control signals at inputs 309 for purposes of selectively enabling the current source or voltage regulator modes of operation and correspondingly control switch control signals 312. The control logic 310 also is coupled to the output of a comparator 360, which may be used to control whether the linear regulator 200 operates in the voltage regulation or current source mode based on the $V_{OUT}$ output voltage.

Figure 3A:
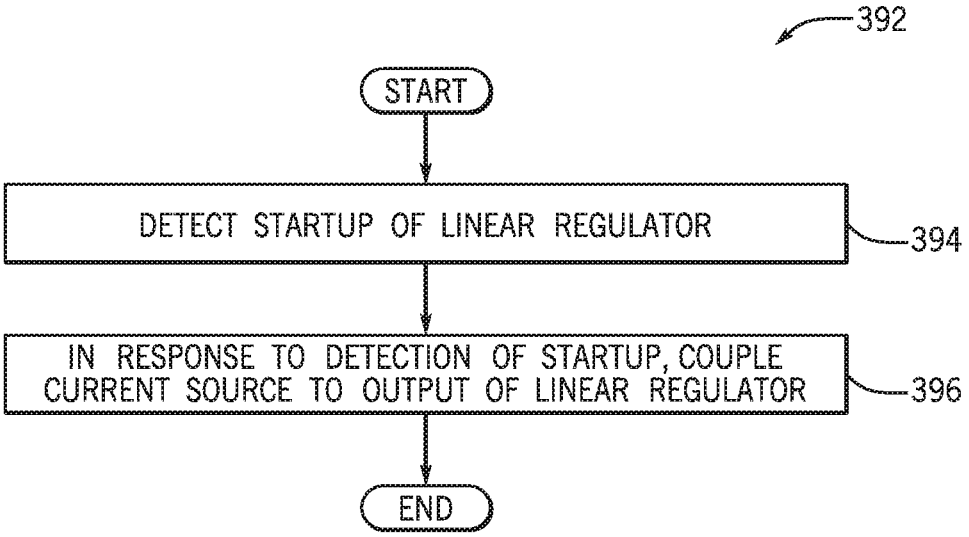
FIG. 3A is a flow diagram depicting operations associated with a startup of a linear regulator according to an example embodiment.

As depicted in FIG. 3, the comparator 360 has an inverting input that is coupled to a feedback node 333 (to provide a scaled representation of the $V_{OUT}$ output voltage) and a non-inverting input that receives the $V_{REF}$ reference voltage. Due to this arrangement, the comparator 360 asserts (drives high, for example) its output signal in response to the feedback voltage at node 333 being below a threshold. As shown in FIG. 3, the switch control signals 312 may be used to control switches 316 (switches 316-1, 316-2 and 316-3, being depicted as examples in FIG. 3), which may be used to selectively control the circuitry that is coupled to the gate of the PMOSFET 322. Referring to FIG. 3A, thus, in accordance with an example embodiment, a technique 392 includes detecting (block 394) startup of a linear regulator and in response to detection of the startup, coupling (block 396) a current source to an output of the linear regulator.

In accordance with example embodiments, the control logic 310 closes one of the switches 316 and opens the other two switches 316 for purposes of configuring the linear regulator 200 for a given mode of operation. In this manner, to configure the linear regulator 200 for the voltage regulator mode (in response to the $V_{OUT}$ output voltage exceeding a threshold voltage, for example), the control logic 310 closes the switch 316-3 (as depicted in FIG. 3) to couple the output of the error amplifier 350 to a control terminal of the pass device 310. For the current source mode (in response to the $V_{OUT}$ output voltage being below the threshold voltage at startup, for example), the control logic 310 closes the switch 316-2 to couple the control terminal of the pass device 320 to a current mirroring device 340 for purposes of regulating the $I_{LOAD}$ output current of the linear regulator. To turn disable, or turn off the linear regulator 200, the control logic 310 closes the switch 316-1 to turn off the pass device 320.

For the example embodiment depicted in FIG. 3, the load 376 represents electrical circuits, which are permanently coupled to the output 370 of the linear regulator 200, such as the processing core 150, low voltage peripherals, and so forth, which are powered by the linear regulator 200 regardless of the particular power consumption mode of the MCU 24. The load 380 represents other electrical circuits, which may be switched (via switches 378 and 382) to the output 370 for higher power consumption modes of the MCU 24 but may be decoupled from the output 370 for lower power consumption modes of the MCU 24.

In accordance with example embodiments, the linear regulator 200 may be part of a semiconductor package 30 (as depicted in FIG. 1), which has terminals 391 that are accessible outside the package 30 for purposes of coupling a decoupling capacitor 390 to the linear regulator 200. The decoupling capacitor 390 may be used for such purposes as filtering noise that may otherwise appear at the output 370 due to operation of the loads 376 and/or 380. As described further herein, in accordance with example embodiments, the linear regulator 200 has a closed loop frequency gain that takes into account the impedance of the decoupling capacitor 390.

As depicted in FIG. 3, in accordance with example embodiments, the pass device 320 may be formed by a metal-oxide-semiconductor field-effect-transistor (MOSFET), such as a p-channel MOSFET (PMOSFET) 322. In the regard, the source of the PMOSFET 322 is coupled to receive the $V_{IN}$ input voltage, the gate of the PMOSFET 322 forms the control terminal of the pass device 320 and is coupled to the output of the error amplifier 350 by the switch 316-3 in the voltage regulator mode of the linear regulator 200. The drain of the PMOSFET 322 is coupled to the output 370 of the linear regulator 200.

The feedback path 330, in accordance with example embodiments, includes a resistor divider that is formed from resistors 332 and 334 for purpose of creating a scaled representation of the $V_{OUT}$ output voltage at the node 333. In this regard, the resistor 332, which may be adjustable, is coupled between the output 370 and the node 333; and the resistor 334 is coupled between the feedback node 333 and ground. Moreover, as depicted in FIG. 3, in accordance with example embodiments, a switch 336 may be coupled between the resistor 334 and ground for purposes of selectively enabling and disabling the feedback path 330.

The current mirroring device 340 is part of the circuitry of the linear regulator 200 used for purposes of the current source mode of operation. More specifically, in accordance with example embodiments, the linear regulator 200 uses the current mirroring device (a MOSFET 342, for example) to mirror a current source 326 that is provided by a current source 326 into the source-to-drain path of the PMOSFET 322 (i.e., into the current path of the pass device 320) for purposes of limiting the $I_{LOAD}$ output current of the linear regulator 200, as further disclosed herein.

As also depicted in FIG. 3, the error amplifier 350 includes a low pass filter 324. As discussed in more detail herein, the low pass filter 324 is used to introduce a frequency pole, or roll off, to the closed loop frequency response of the linear regulator 200 for purposes of compensating for a frequency zero that is introduced by the produce of the on path (or closed path) resistance of the switch 378 and the capacitance of the decoupling capacitor 390.

Figure 4:
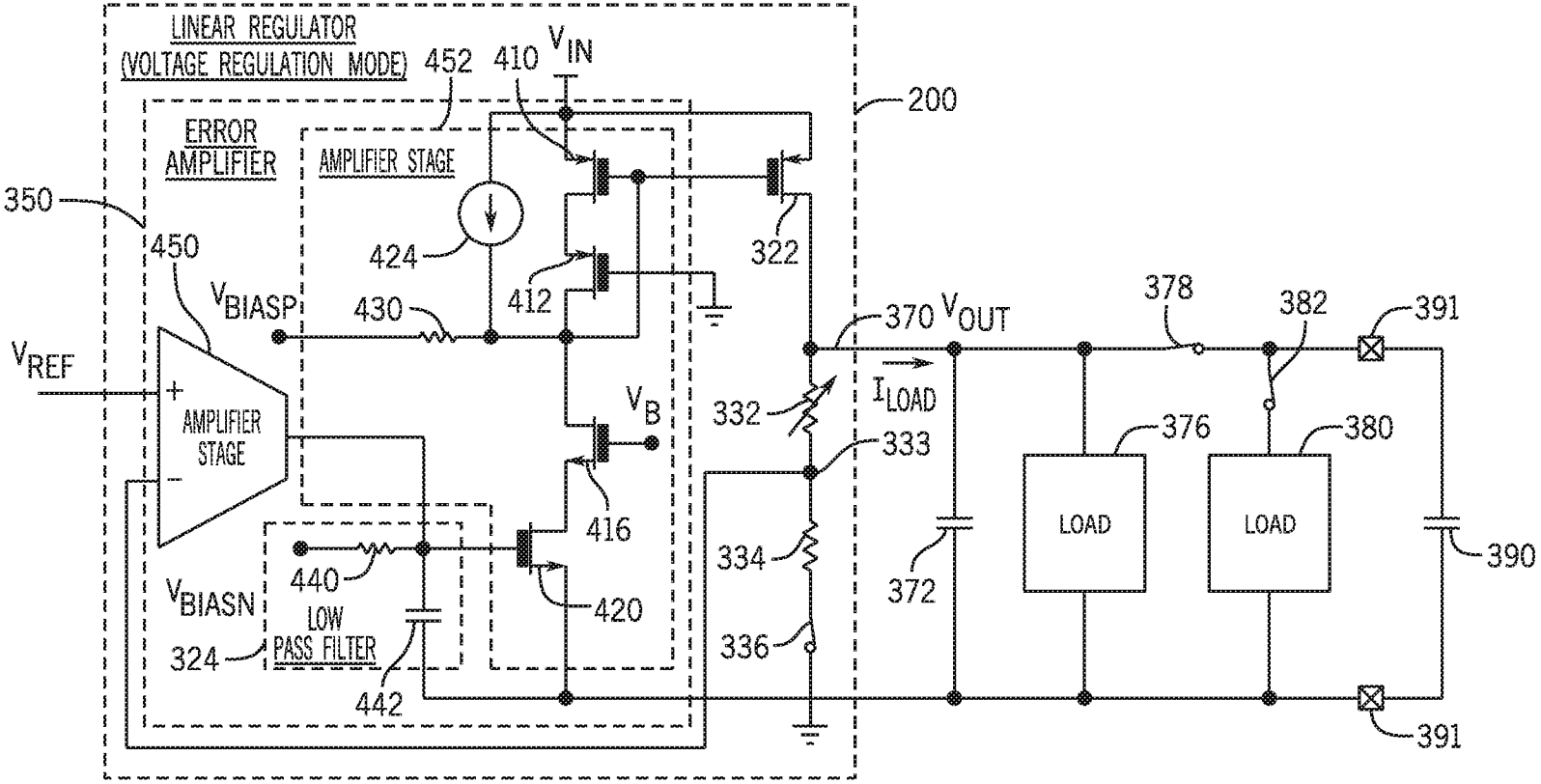
FIG. 4 is a schematic diagram of the linear regulator illustrating a voltage regulation mode of the regulator according to an example embodiment.

FIG. 4 depicts a more detailed example embodiment of the linear regulator 200, illustrating the voltage regulation mode of operation. Referring to FIG. 4, for this example embodiment, the error amplifier 350 includes two stages: a first transconductance amplifier stage 450 and a second transconductance amplifier stage 452. The first transconductance amplifier stage 450 produces a current at its output in response to the comparison of the voltage at the feedback node 333 to the $V_{REF}$ reference voltage. This voltage, in turn, is received by the low pass filter 324. The low pass filter 324 filters the current, converts the current into a voltage and provides the voltage to the amplifier stage 452.

As depicted in FIG. 4, in accordance with example embodiments, the low pass filter 324 may include a resistor 440 that is coupled between the output of the transconductance amplifier 450 and a bias voltage (called "$V_{BIASN}$" in FIG. 4); and a capacitor 440 is coupled between the output of the amplifier stage 450 and ground.

The amplifier stage 452 includes an N-channel metal-oxide-semiconductor field-effect transistor (NMOSFET) 420. The gate of the NMOSFET 420 is coupled to output of the amplifier stage 450, the source of the NMOSFET 420 is coupled to ground, and the drain of the NMOSFET 420 is coupled to the source of another NMOSFET 416.

The gate of the NMOSFET 416 receives a bias voltage, and the drain of the NMOSFET 416 is coupled to the drain of a PMOSFET 412. The gate of the PMOSFET 412 is coupled to ground, and the source of the PMOSFET 412 is coupled to the drain of a PMOSFET 410. As depicted in FIG. 4, the gate of the PMOSFET 410 is coupled to the gate of the PMOSFET 322, and the source of the PMOSFET 410 receives the $V_{IN}$ input voltage. A current source 424 is coupled between the drain of the PMOSFET 412 and the $V_{IN}$ input voltage, and a resistor 430 is coupled between a bias voltage (called "$V_{BIASP}$") in FIG. 4.

Due to the above-described arrangement, the amplifier stage 452 converts the voltage at the gate of the NMOSFET 420 into a current that is mirrored into the source-to-drain path of the PMOSFET 322. In response to the $V_{OUT}$ output voltage increasing, the current provided by the output of the amplifier stage 450 decreases, thereby decreasing the gate voltage of the NMOSFET 420 and decreasing the current in the drain-to-source path of the NMOSFET 420. Correspondingly, due to the current mirroring by the PMOSFETs 410 and 322, the current in the source-to-drain path of the PMOSFET 322 decreases, which lowers the $V_{OUT}$ output voltage. In response to the $V_{OUT}$ output voltage decreasing, the current provided by the output of the amplifier stage 450 increases, thereby increasing the gate voltage of the NMOSFET 420 and increasing the current in the drain-to-source path of the NMOSFET 420. Correspondingly, due to the current mirroring by the PMOSFETs 410 and 322, the current in the source-to-drain path of the PMOSFET 322 increases, which raises the $V_{OUT}$ output voltage.

In accordance with example embodiments, the aspect ratio of the PMOSFET 410 is significantly smaller than the aspect ratio of the PMOSFET 322, which allows for relatively small bias currents for the amplifier 350. As an example, in accordance with some embodiments, the ratio may be 350 (for the PMOSFET 322) to 1 (for the PMOSFET 410); and the quiescent bias current of the amplifier 350 may be 15 to 20 microamperes (μA). Other aspect ratios and bias currents may be used, in accordance with further example embodiments.

Figure 5A:
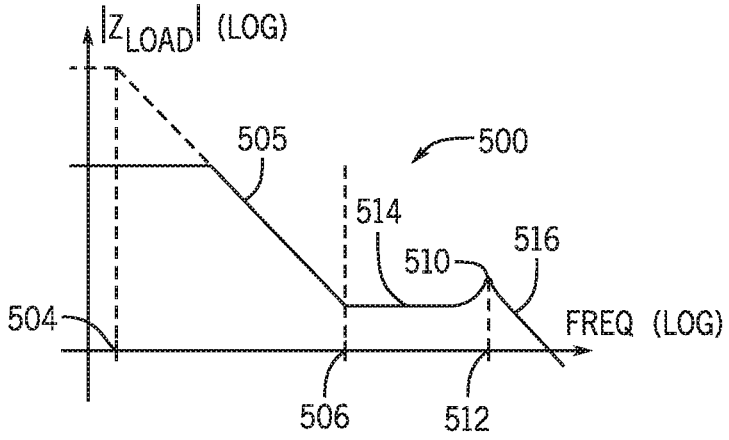
FIG. 5A is a Bode plot of an impedance coupled to the output of the linear regulator according to an example embodiment.

Referring to FIG. 5A in conjunction with FIG. 4, in accordance with example embodiments, the magnitude ($|Z_{LOAD}|$) of the frequency response of the load ($Z_{LOAD}$) on the linear regulator 200 may be represented by an example Bode plot 500. In this context, the $Z_{LOAD}$ load refers to the load downstream of the linear regulators' output (e.g., in FIG. 4, the impedance of switch 378, the load 376, the impedance 383 of switch 382, the load 380 and the capacitance of the decoupling capacitor 390). As depicted by the Bode plot 500, the $|Z_{LOAD}|$ magnitude may have an initial pole frequency 504 (called "$pole_{load}$"), a 3 dB rolloff frequency, which is a function of the resistance of the load at the output 370 ($r_{load}$) and the capacitance ($c_{ext}$) of the capacitor 390, as set forth below:

$$pole_{load}=1/(2\pi\cdot r_{load}\cdot c_{ext}). \quad \text{Eq. 1}$$

As depicted in FIG. 5A, the $|Z_{LOAD}|$ magnitude has a DC gain that generally extends to the pole frequency 504 and rolls off, as depicted at reference numeral 505, at −20 dB per decade rate until a frequency associated with a zero frequency 506 ($zero_{load}$) is reached. The $zero_{load}$ zero frequency is a product of the resistance ($r_{onsw}$) of the switch 378 and the $c_{ext}$ capacitance of the decoupling capacitor 390, as set forth below:

$$zero_{load}=1/((2\pi\cdot r_{onsw}\cdot c_{ext})). \quad \text{Eq. 2}$$

At the $zero_{load}$ zero frequency 506, the $|Z_{LOAD}|$ magnitude levels out until the $|Z_{LOAD}|$ magnitude reaches a frequency 512 at which the $|Z_{LOAD}|$ magnitude peaks (as depicted at reference numeral 510) due to wire inductance before rolling off at a −20 dB per decade rate, as depicted at reference numeral 516.

In accordance with example embodiments, the frequency response of the linear regulator 200 is constructed so that the overall frequency response for the combined regulator 200 and load (herein called the "combined frequency response") exhibits a dominant pole-like frequency response. In this manner, in accordance with example embodiments, the magnitude of the combined frequency response has a DC gain that extends to or near a single pole frequency and then decays thereafter at a −20 dB per decade rate.

Figure 5B:
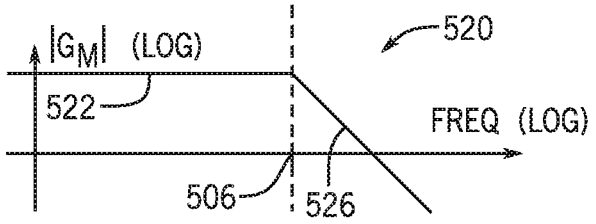
FIG. 5B is a Bode plot of a closed loop gain of the linear regulator in the absence of a load according to an example embodiment.

The dominant pole for the combined frequency response, in accordance with example embodiments, is established using the LPF 324 of the linear regulator 200. More specifically, referring to FIG. 5B in conjunction with FIG. 5A, in accordance with example embodiments, a magnitude (called "$|G_M|$") 520 of the linear regulator's frequency response (not considering the load) has a DC gain 522 that extends to a pole frequency 506 (called "$pole_{LPF}$") at which the $|G_M|$ magnitude decays at a −20 dB slope 526.

Figure 5C:
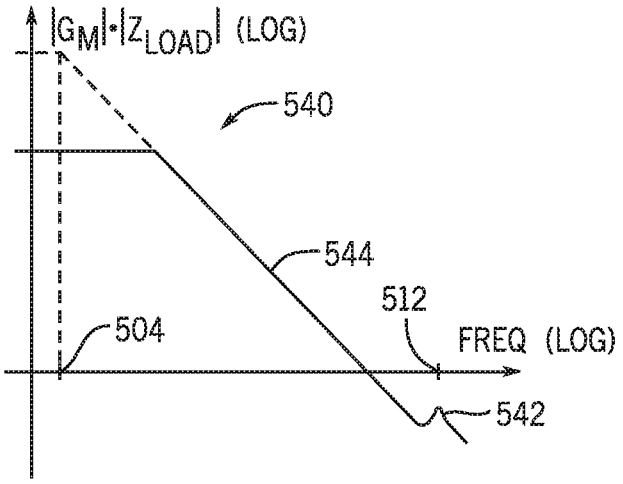
FIG. 5C is a Bode plot of the closed loop gain of the linear regulator when coupled to the load according to an example embodiment.

In accordance with example embodiments, the $pole_{LPF}$ pole frequency is at or near the $zero_{load}$ zero frequency (within one decade of the $zero_{load}$ zero frequency, for example). For the low pass filter 324 that is depicted in FIG. 4, the $pole_{LPF}$ pole frequency may be described as follows:

$$pole_{LPF}\approx 1/(2\pi\cdot r1\cdot c1), \quad \text{Eq. 3}$$

where "r1" represents the resistance of the resistor 440; and "c1" represents the capacitance of the capacitor 442. Referring to FIG. 5C, if the $pole_{LPF}$ pole frequency is equal to the $zero_{load}$ zero frequency, then the magnitude 540 ($|G_M|\cdot|Z_{LOAD}|$) of the combined frequency response has a single dominant pole frequency 504 and a −20 dB per decade roll off 544. The magnitude 540 includes a rise 542 due to wire inductance. A particular advantage of such a combined frequency response is that although the DC gain for the regulator 200 (see FIG. 5B) may consequently be relatively small, the regulator has an enhanced dynamic response for purposes of rapidly responding to a changing load.

It is noted that in accordance with example embodiments, the $zero_{load}$ zero frequency and the $pole_{LPF}$ pole frequency may cancel each other so that single dominant pole frequency response results. However, the cancellation does not need to be perfect. For example, in accordance with further example embodiments, the $pole_{LPF}$ pole frequency may be lower or higher than the $zero_{load}$ zero frequency within a certain range (the $pole_{LPF}$ pole frequency may be, for example, a frequency in the range of one fourth the $zero_{load}$ zero frequency to four times the $zero_{load}$ zero frequency) and still result in a satisfactory phase margin and stability for the linear regulator 200.

Figure 6:
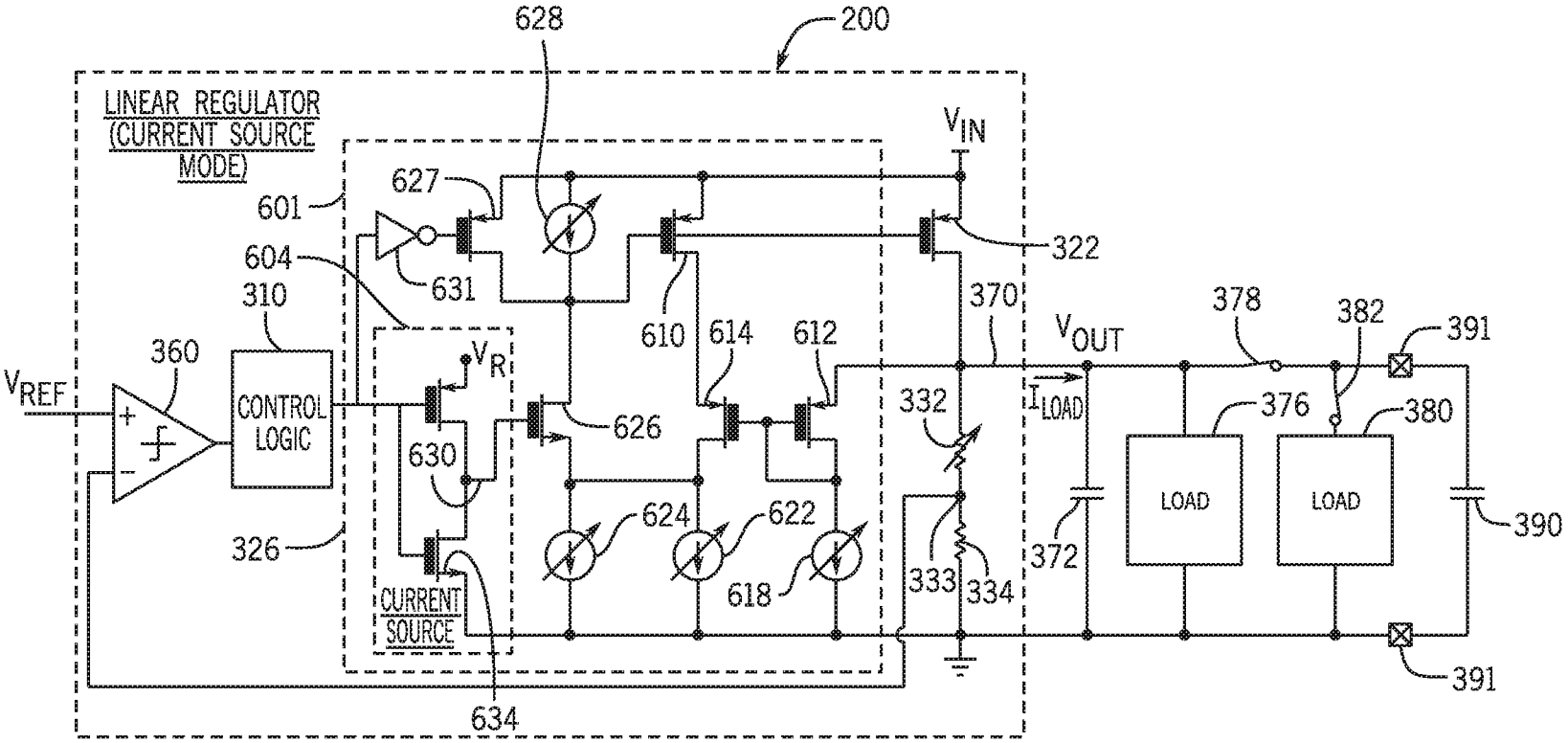
FIG. 6 is a schematic diagram of the linear regular illustrating a current source mode operation of the linear regulator according to an example embodiment.

FIG. 6 depicts configuration of the linear regulator 200 for the current source mode of operation. Referring to FIG. 6, in accordance with example embodiments, a current source 601 (to replace the current source 326 and the mirroring device 340 of FIG. 3) of the linear regulator 200 limits the current at the output 370 during the current source mode. The current source 601 includes a complementary metal oxide semiconductor (CMOS) inverter 604 that is formed from a PMOSFET 630 and an NMOSFET 634. In this regard, the inverter 604 receives a signal from the control logic 310 for purposes of enabling operation of the current source 634. When enabled, the control logic 310 deasserts (drives low, for example) a signal that is furnished to the inverter 604 to cause the inverter 604 to correspondingly assert (drive high, for example) the gate of an NMOSFET 626 to turn on the NMOSFET 626 and cause the drain-to-source path of the NMOSFET 626 to conduct. The deassertion of the signal also causes another inverter 631 to assert the gate of a PMOSFET 627 to turn off the PMOSFET 627.

The NMOSFET 626, two current sources 624 and 628 form a bias circuit for the current source 601. The source of MOSFET 626 is coupled to the current source 624, which is coupled between the source of MOSFET 626 and ground. The drain of the NMOSFET 626 is coupled to the current source 628, and the current source 628 is coupled between the $V_{IN}$ input voltage and the drain of the NMOSFET 626. The current sources 624 and 628 conduct the same current and are oriented to provide a predefined bias current through the drain-to-source path of the NMOSFET 626. The drain and source of the NMOSFET 626 provide bias voltages to the other circuitry of the current source 601.

More specifically, the drain of the NMOSFET 626 is coupled to the gate of a PMOSFET 610, and the source of the NMOSFET 626 is coupled to the drain of a PMOSFET 614. The source of the PMOSFET 610 receives the $V_{IN}$ input voltage, the gate of the PMOSFET 610 is coupled to the gate of the PMOSFET 322, and the drain of the PMOSFET 610 is coupled to the source of the PMOSFET 614. The drain of the PMOSFET 614 is coupled to a current source 622, and the current source 622 is coupled between the drain of the PMOSFET 614 and ground. The gate of the PMOSFET 614 is coupled to the gate of a PMOSFET 612, and the gate and drain of the PMOSFET 612 are coupled together. Moreover, the drain of the PMOSFET 612 is coupled to a current source 618 and the source of the PMOSFET 612 is coupled to the output 370.

In accordance with example embodiments, the current through the drain-to-source path of the PMOSFET 322 is the product of the current of the current source 622 and a scaling factor. The scaling factor is a ratio of the aspect ratio of the PMOSFET 322 to the aspect ratio of the PMOSFET 610.

Figure 7:
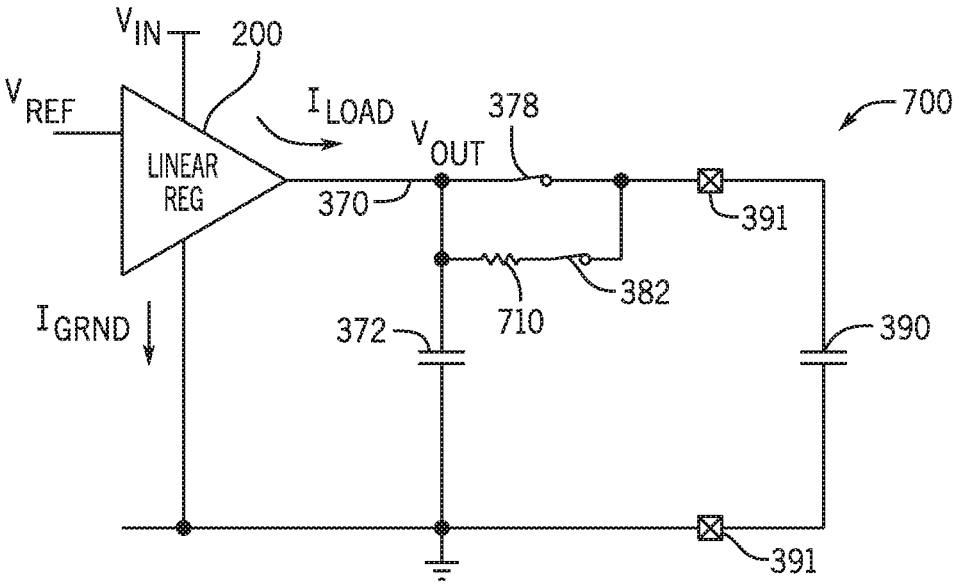
FIG. 7 is a schematic diagram illustrating ground and load currents of the linear regulator according to an example embodiment.

Referring to FIG. 7 in conjunction with FIG. 6, in accordance with example embodiments, in the voltage regulation mode of operation, the linear regulator 200 supplies the $I_{LOAD}$ current and conducts a ground current (called "$I_{GND}$" in FIG. 7), representing the overall quiescent bias current. The $I_{GND}$ current may be significantly smaller that the $I_{LOAD}$. For example, in accordance with example embodiments, for an $I_{LOAD}$ current of 50 milliamperes (mA), the $I_{GND}$ current is about 150 μA.

The linear regulator 200 may provide one or more of the following advantages, in accordance with example embodiments. The linear regulator 200 may have a relatively low bias current (a current less than 20 μA, for example) during the voltage regulation mode for a light load. The linear regulator 200 may provide tight load and line regulation. The linear regulator 200 may provide a large phase margin (a phase margin over 40 degrees, for example) for a wide range of load current (a current ranging from 1 μA to 100 mA, for example). The linear regulator 200 may occupy a relatively small die area. Other and different advantages are possible, in accordance with further embodiments.

Figure 8:
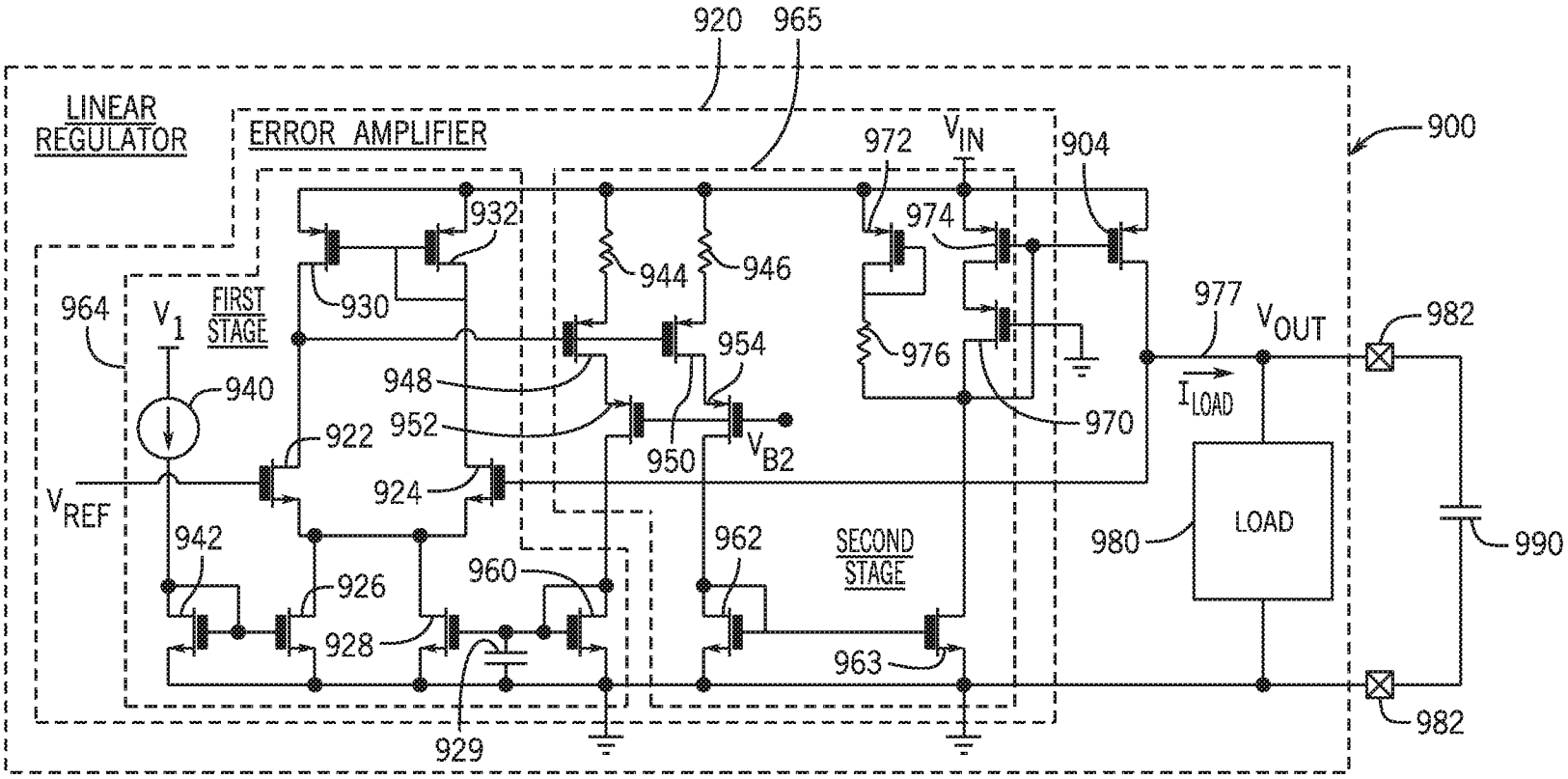
FIG. 8 is a schematic diagram of a linear regulator according to a further example embodiment.

Referring to FIG. 8, in accordance with further example embodiments, the MCU 24 may use a linear regulator 900 to provide a regulated voltage for a lower load current (a current less than 5 mA, for example). For the example embodiment of FIG. 8, the linear regulator 900 provides a $V_{OUT}$ output voltage (at output 977) to a load 980 and a decoupling capacitor 990 may be coupled to between the output 977 and ground at package terminals 982. For this embodiment, the MCU 24 may include a switch (not shown) to couple the package terminals 982 to the output 977, similar to the switch 378 of FIG. 6, for example.

Similar to the linear regulator 200, the linear regulator 900 includes a transconductance amplifier 920 that regulates a current in a pass device, a PMOSFET 904, for purposes of converting a $V_{IN}$ input voltage into the regulated $V_{OUT}$ output voltage. The amplifier 920, however, has a different topology than the linear regulator 200 and may consume less quiescent bias current than the amplifier 350 of the linear regulator 200, in accordance with example embodiments.

The amplifier 920 includes a first amplifier stage 964 and a second amplifier stage 965. The first amplifier stage 964 is a differential voltage amplification stage that provides a voltage to the second amplifier stage 965 in response to a differential voltage formed between the output 997 and a $V_{REF}$ reference voltage. More specifically, the first amplifier stage 964 includes a differential transistor pair formed from NMOSFETs 922 and 924. In this manner, the gate of the NMOSFET 922 receives the $V_{REF}$ reference voltage, and gate of the NMOSFET 924 is coupled to the output 977. The sources of the NMOSFETs 922 and 924 are coupled together, and the drain of the NMOSFET 922 provides an output voltage for the amplifier. The drain of the NMOSFET 922 is coupled to the drain of a PMOSFET 930, and the drain of the NMOSFET 924 is coupled to the gate and drain of a PMOSFET 932. The NMOSFETs 930 and 932 form a current mirror. The gates of the NMOSFETs 930 and 932 are coupled together. Moreover, the sources of the PMOSFETs 930 and 932 receive the $V_{IN}$ input voltage.

The NMOSFETs 922 and 924 receive two bias currents: a first fixed bias current that is provided by a current source 940 and routed to the NMOSFETs 922 and 924 through the drain-to-source current path of an NMOSFET 926; and a second bias current that affected by feedback from the second stage an is routed to the NMOSFETs 922 and 924 through the drain-to-source current path of an NMOSFET 928.

The NMOSFET 926 forms a current mirror with an NMOSFET 942. In this regard, the gates of the NMOSFETs 926 and 942 are coupled together, and the source and drain of the NMOSFET 942 are coupled together. The sources of the NMOSFETs 926 and 942 are coupled to ground. The drain-to-source current path of the NMOSFET 942 is coupled to receive current from the current source 940, which is coupled between the drain of the NMOSFET 942 and a bias voltage (called "$V_1$" in FIG. 8).

The source of the NMOSFET 928 is coupled to ground, and the NMOSFET 928 forms a current mirror with an NMOSFET 960. In this regard, the gates of the NMOSFETs 928 and 960 are coupled together, and the gate and drain of the NMOSFET 960 are coupled together. The sources of the NMOSFETs 928 and 960 are coupled to ground.

As also depicted in FIG. 8, a capacitor 929 is coupled between the gates of the NMOSFETs 928 and 960 and ground. In accordance with example embodiments, the capacitor 929 improves the bias current feedback stability of the linear regulator 900. The capacitor 929 may be omitted, in accordance with further example embodiments.

The drain and gate of the NMOSFET 960 are coupled to the drain of the PMOSFET 952, and the source of the PMOSFET 952 is coupled to the drain of a PMOSFET 948. A resistor 944 may be coupled between the $V_{IN}$ reference voltage and the source of the PMOSFET 948. The gate of the NMOSFET 948 is coupled to the gate of an NMOSFET 950, for purposes of mirroring current in the source-to-drain path of the NMOSFET 948 into the source-to-drain path of the NMOSFET 950. As depicted in FIG. 8, a resistor 946 may be coupled between the source of the PMOSFET 950 and the $V_{IN}$ input voltage, and the drain of the PMOSFET 950 is coupled to the source of a PMOSFET 954. The gates of the PMOSFETs 952 and 954 receive a bias voltage (called "$V_{B2}$" in FIG. 8). The drain of the PMOSFET 954 is coupled to gate and drain of an NMOSFET 962.

The NMOSFET 962 forms a current mirror with another NMOSFET 963. In the regard, the gate and drain of the NMOSFET 962 are coupled to the gate of the NMOSFET 963; and sources of the NMOSFETs 962 and 963 are coupled to ground. The drain of the NMOSFET 963 is coupled to the drain a PMOSFET 970, which has its gate coupled to ground. The source of the PMOSFET 970 is coupled to the drain of another PMOSFET 974, and the source of the PMOSFET 974 receives the $V_{IN}$ input voltage. The gate of the PMOSFET 974 is coupled to the gate of the pass PMOSFET 904. A resistor 976 may be coupled between gate and drain of another PMOSFET 972, and the source of the PMOSFET 972 receives the $V_{IN}$ input voltage.

Figure 9:
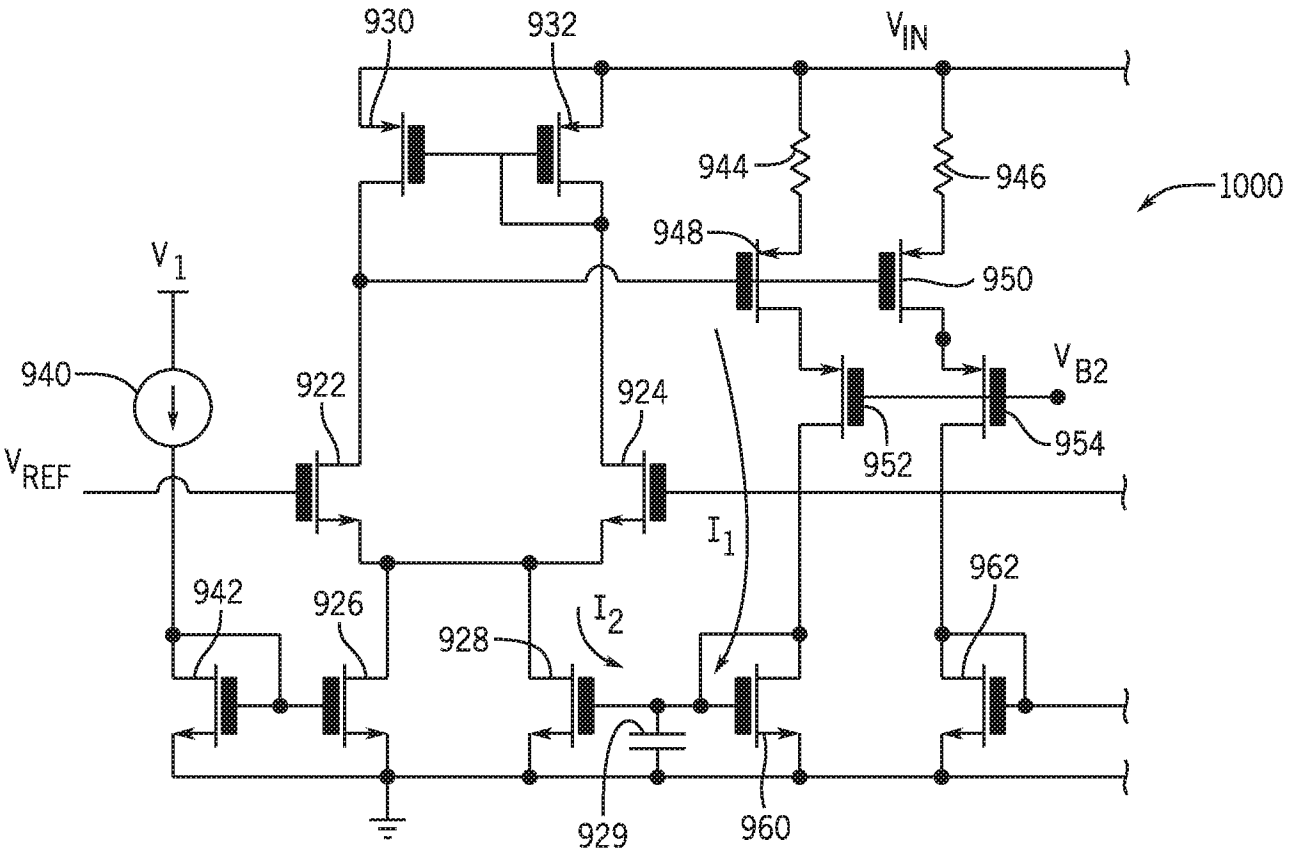
FIG. 9 is a schematic diagram illustrating bias current feedback for the linear regulator of FIG. 8 according to a further example embodiment.

Due to the above-described arrangement, the first amplifier stage 964 amplifies the difference between the $V_{OUT}$ and $V_{REF}$ voltages to provide an input voltage (received at the gates of PMOSFETs 948 and 950) to the second amplifier stage 965. The second amplifier stage 965 amplifies its input voltage to provide the current in the source-to-drain path of the PMOSFET 904 (the pass device). In response to the $V_{OUT}$ output voltage increasing, the voltage that is provided by the first amplifier stage 964 to the second amplifier stage 965 increases. Correspondingly, the second amplifier stage 965 decreases the current in the source-to-drain path of the PMOSFET 904 to lower the $V_{OUT}$ output voltage. In response to the $V_{OUT}$ output voltage decreasing, the voltage that is provided by the first amplifier stage 964 to the second amplifier stage 965 decreases. Correspondingly, the second amplifier stage 965 increases the current in the source-to-drain path of the PMOSFET 904 to raise the $V_{OUT}$ output voltage FIG. 9 is an illustration of bias current feedback of the linear regulator 900, in accordance with example embodiments. Referring to FIG. 9 in conjunction with FIG. 8, in response to the $I_{LOAD}$ current increasing, the current (called "$I_1$" in FIG. 9) in the drain-to-source path of the NMOSFET 960 increases, which correspondingly causes the current (called "$I_2$" in FIG. 9) in the drain-to-source path of the NMOSFET 928 to increase.

It is noted that the resistors 944 and 946 may be omitted, in accordance with further example embodiments (i.e., the sources of the PMOSFETs 948 and 950 may receive the $V_{IN}$ input voltage). With resistors 944 and 946 present, however, the sizes of the PMOSFETs 948 and 950 may be reduced and in accordance with some embodiments, the frequency response of the regulator 900 may be enhanced.

The linear regulator 900 may provide one or more of the following advantages, in accordance with example embodiments. The linear regulator 200 may have a relatively low quiescent bias current (a current of about 35 nanoamperes (nA) for a load current of zero and a current of about 10 μA for a load current of 5 mA, in accordance with an example embodiment). As discussed above, the linear regulator 900 may provide bias current feedback to allow a relatively low quiescent bias current while providing a relatively fast transient response. The linear regulator 900 may provide tight load and line regulation. For example, in accordance with example embodiments, for the $V_{IN}$ input voltage changing from 1.5 V to 3.8 V, the $V_{OUT}$ output voltage may change less than one millivolt (mV); and in accordance with example embodiments, for the $I_{LOAD}$ load current varying from 1 nA to 5 mA, the $V_{OUT}$ output voltage may change about 5 mV. The linear regulator 900 may provide a relatively large phase margin (a phase margin greater than 45 degrees, for example) for a wide range of load current (a current ranging from 1 nA to 10 mA, for example). The linear regulator 900 may occupy a relatively small die area. Other and different advantages are possible, in accordance with further embodiments.

Figure 10:
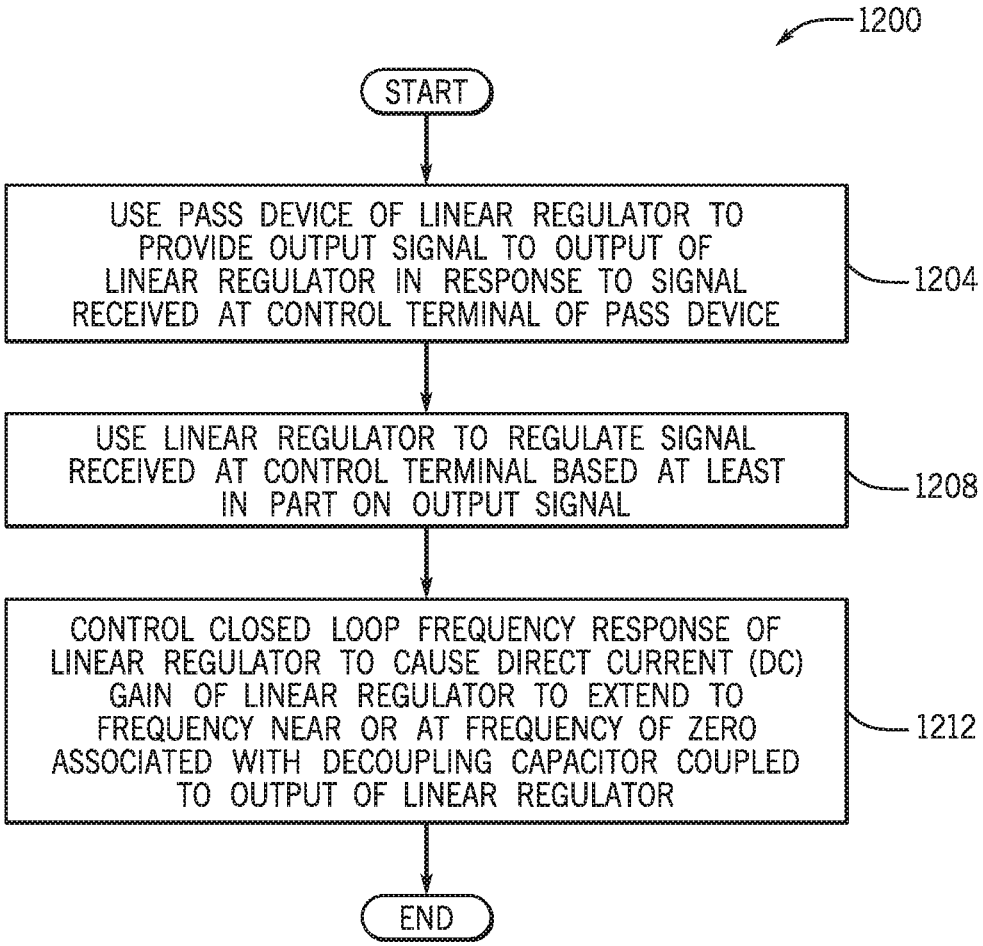
FIG. 10 is a flow diagram depicting a technique to regulator a linear regulator according to a further example embodiment.

Referring to FIG. 10, in accordance with example embodiments, a technique 1200 includes using (block 1204) a pass device of a linear regulator to provide an output signal to an output of the linear regulator in response to a signal that is received at a control terminal of the pass device. The technique 1200 includes using (block 1208) the linear regulator to regulate the signal received at the control terminal of the pass device based at least in part on the output signal. The technique 1200 further includes controlling (block 1212) the closed loop frequency response of the linear regulator to cause a direct current (DC) gain of the linear regulator to extend to a frequency that is near or at the frequency of a zero that is associated with a decoupling capacitor, which is coupled to the output of the linear capacitor.

While a limited number of embodiments have been disclosed herein, those skilled in the art, having the benefit of this disclosure, will appreciate numerous modifications and variations therefrom. It is intended that the appended claims cover all such modifications and variations.

What is claimed is:

1. A method comprising:

using a pass device of a linear regulator to provide an output signal to an output of the linear regulator in response to a signal received at a control terminal of the pass device, wherein the pass device and the linear regulator are part of an integrated circuit (IC);

using the linear regulator to regulate the signal received at the control terminal based at least in part on the output signal; and controlling a closed loop frequency response of the linear regulator to cause a direct current (DC) gain of the linear regulator to extend to a frequency near or at frequency of a zero associated with a decoupling capacitor external to the IC and coupled to the output of the linear regulator, wherein controlling the closed loop frequency response comprises controlling the closed loop frequency response based at least in part on a capacitance of the decoupling capacitor.

2. The method of claim 1, wherein controlling the closed loop frequency response further comprises controlling the closed loop frequency response based at least in part on a product of the capacitance of the decoupling capacitor and an impedance of a switch used to selectively couple the pass device to the output.

3. The method of claim 1, wherein:

using the linear regulator to regulate the signal comprises providing a feedback signal based at least in part on the output signal and using an amplifier of the linear regulator to provide the signal to the control terminal; and controlling the closed loop frequency response of the closed-loop circuit comprises low pass filtering the feedback signal.

4. The method of claim 1, further comprising:

detecting startup of the linear regulator; and in response to detection of the startup, coupling a current source to the output of the linear regulator.

5. The method of claim 1, wherein controlling the closed loop frequency response comprises controlling the closed loop frequency response to cause a combined frequency response of the linear regulator and a frequency response of a load coupled to the output of the linear regulator to have a single pole.

6. The method of claim 3, wherein using the amplifier comprises using a transconductance amplifier.

7. An apparatus comprising:

an integrated circuit comprising a linear regulator, the linear regulator comprising a closed loop circuit comprising a pass device, a feedback circuit, an amplifier and a filter;

wherein the filter is adapted to control a first order roll off frequency of a frequency response of the closed loop circuit to cause the first order roll off frequency to be near or at frequency of a zero associated with a load coupled to an output of the linear regulator; and wherein the frequency of the zero is attributable to a capacitance of a decoupling capacitor and a resistance of a switch path that couples an output of the linear regulator to the decoupling capacitor.

8. The apparatus of claim 7, wherein:

the linear regulator regulates an output voltage;

the amplifier comprises a first transconductance amplification stage and a second transconductance amplification stage;

the first transconductance amplification stage to provide a current in response to the output voltage and a reference signal;

the filter to convert the current into a filtered voltage; and the second transconductance amplification stage to regulate a current in the pass device in response to the filtered voltage.

9. The apparatus of claim 7, wherein the pass device comprises a transistor comprising a current path having a current controlled in response to a signal received at a control terminal of the transistor.

10. The apparatus of claim 7, wherein the integrated circuit further comprises a processor core to receive power from the linear regulator.

11. The apparatus of claim 7, wherein the filter comprises a low pass filter.

12. The apparatus of claim 7, wherein the amplifier comprises a first amplification stage and a second amplification stage coupled to an output of the first amplification stage, and the filter is coupled to the output of the first amplification stage.

13. An apparatus comprising:

an integrated circuit comprising a linear regulator, the linear regulator comprising a closed loop circuit comprising a pass device, a feedback circuit, an amplifier and a filter;

wherein:

the filter is adapted to control a first order roll off frequency of a frequency response of the closed loop circuit to cause the first order roll off frequency to be near or at frequency of a zero associated with a load coupled to an output of the linear regulator;

the linear regulator regulates an output voltage;

the amplifier comprises a first transconductance amplification stage and a second transconductance amplification stage;

the first transconductance amplification stage to provide a current in response to the output voltage and a reference signal;

the filter to convert the current into a filtered voltage; and the second transconductance amplification stage to regulate a current in the pass device in response to the filtered voltage.

* * * * *